United States Patent [19]

Sprague

[11] 4,439,057

[45] Mar. 27, 1984

[54] SOIL COMPACTOR DRIVE ASSEMBLY

[76] Inventor: Gale Sprague, R.R. 2, St. Joseph, Mo. 64505

[21] Appl. No.: 366,305

[22] Filed: Apr. 7, 1982

[51] Int. Cl.[3] ..... E01C 19/34; F16H 23/04

[52] U.S. Cl. ..... 404/133; 74/60; 173/123

[58] Field of Search ..... 404/133, 112, 113, 114; 74/87, 56, 60; 173/94, 123

[56] References Cited

U.S. PATENT DOCUMENTS

| | | | |
|---|---|---|---|
| 1,838,186 | 12/1931 | Moodhe | 173/123 X |
| 2,211,741 | 8/1940 | Elwell | 173/123 X |
| 2,913,911 | 11/1959 | Gilkey | 74/60 |
| 2,997,956 | 8/1961 | Stewart | 74/60 X |
| 3,322,208 | 5/1967 | Skoog | 173/123 |
| 3,592,111 | 7/1971 | Livingston et al. | 404/133 |
| 3,899,262 | 8/1975 | Yamamoto | 404/133 |
| 3,997,278 | 12/1976 | Riedl | 404/133 |
| 4,221,545 | 9/1980 | Terauchi | 74/60 X |
| 4,224,003 | 9/1980 | St. Louis | 404/133 |

FOREIGN PATENT DOCUMENTS

| | | | |
|---|---|---|---|
| 726250 | 4/1980 | U.S.S.R. | 404/113 |

*Primary Examiner*—Ernest R. Purser
*Assistant Examiner*—Beverly E. Hjorth
*Attorney, Agent, or Firm*—Kokjer, Kircher, Bradley, Wharton, Bowman & Johnson

[57] ABSTRACT

Apparatus for compacting soil or the like which is designed to be an attachment to a back hoe and to be powered by a hydraulic fluid motor. The drive motor is disposed on a vertical axis and rotates an element which has a generally planar surface oblique to its axis of rotation. This surface moves against a cylindrical drive member and causes it to wobble back and forth thereby providing a reciprocating action which is used to drive shafts on which are mounted tamping feet. The shafts are provided with contact surfaces at their upper ends against which the cylindrical drive member acts. The shafts are round and are closely fitted inside of round sleeves. These sleeves are greased to provide an effective dirt seal. There is a cam follower coupled with each of the round shafts and fitted inside of guide plates to assure a reciprocal action. A similar cam follower prevents rotation of the cylindrical drive member. Springs surrounding the sleeves serve to return the reciprocating members after they have been forced down.

3 Claims, 7 Drawing Figures

SOIL COMPACTOR DRIVE ASSEMBLY

This invention relates generally to reciprocating drive means and, more particularly, to a reciprocating drive particularly adapted for use with a compacting attachment for a back hoe.

It is frequently necessary when utilizing a back hoe for ditching or other excavating purposes to have a compactor to assist in bringing the excavated ground back to its original condition when the excavation is filled. To meet this need, others have proposed attachments for a back hoe boom to serve as a compacting device. Exemplary of the prior art devices is the compactor shown and described in U.S. Pat. No. 3,592,111, issued July 13, 1971.

The patented back hoe device of Livingston is mounted to the articulated boom of a back hoe and is driven by a hydraulic motor supplied with fluid from the tractor hydraulic system. The prior art devices, as exemplified by the referenced patent, utilize a motor having its output shaft disposed on a horizontal axis which, through a chain drive, turns a horizontal shaft. The horizontal shaft is fitted with eccentrics to which the tamping feet are coupled. As the eccentrics are turned, the feet are raised and lowered. In order to help direct the reciprocating feet along lines of linear movement, square shafts are used to mount the feet and these shafts are received by square sleeves. There are numerous disadvantages to such an arrangement. Turning of the eccentrics sets up vibrations which increase wear on the equipment. Also, because the eccentrics on the horizontal shaft do not provide true rectilinear movement, the fit between the sleeves and the square shafts must be relatively loose to accommodate a degree of nonlinear movement. The loose fitting provides an entryway for dirt to enter the mechanism, thus accelerating wear. The nonlinear movement also causes greater wear than would be the case with a true reciprocating linear action. Obviously, the mechanism as described in the referenced patent also has relatively large power requirements because of the afore-mentioned inefficiencies and maintenance cost is high.

The present invention overcomes many of the disadvantages of the prior art by providing a reciprocable drive for a compactor where rotary movement from the drive motor is translated into true linear movement. The efficiency of the device is greatly improved and wear is substantially reduced.

It is, therefore, a primary object of the present invention to provide a reciprocating drive means wherein a rotating member acts directly on two reciprocating members to translate rotary motion into reciprocating motion. This eliminates much of the vibration heretofore associated with eccentric drives.

Another object of the present invention is to provide a reciprocating drive means which does not utilize a chain drive, but instead transfers rotary motion directly to the reciprocating members thereby reducing the number of moving parts and decreasing wear and maintenance.

Another important aim of my invention is to provide a reciprocating drive means particularly adapted for use with a compactor attachment to a back hoe boom wherein the tamping feet are mounted on round shafts which are in turned encased in round sleeves thereby providing for a tight fit which can be greased to keep out dirt and reduce wear.

Another one of the objects of this invention is to provide a compacting device for back hoe booms which may be easily mounted on the boom and utilize the hydraulic system of the accompanying vehicle.

A further aim of the invention is to provide a reciprocating drive mechanism which utilizes a rotatable member having an oblique planar face to translate rotary motion directly to the reciprocating members. This results in less lost motion and reduces the power requirements for the device.

It is still another one the objectives of the invention to provide a reciprocating drive wherein the drive motor need only move the reciprocating member in one direction and a return spring is utilized to move it in the opposite direction.

My invention has as a further one of its objects the provision of a reciprocating drive mechanism as heretofore described wherein the primary wear surfaces are planar and are readily accessible for refurbishing when necessary thereby reducing maintenance costs.

Other objects of the invention will be made clear or become apparent from the following description and claims when read in light of the accompanying drawing, wherein:

Figure 1:
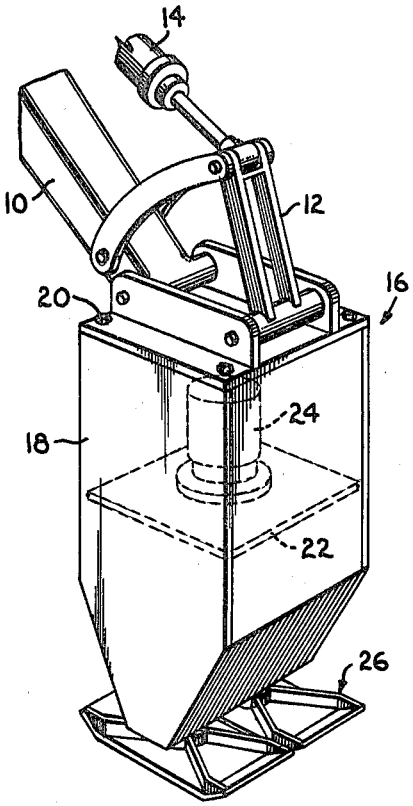
FIG. 1 is a perspective view of a compactor attachment for a back hoe utilizing the reciprocating drive mechanism of the present invention.

Referring initially to FIG. 1, an articulated boom is designated by the numeral 10 and is provided with a pivotal framework 12 coupled with a hydraulic cylinder 14. It is to be understood that boom 10 would normally be mounted on the back of a vehicle such as a tractor (not shown) and framework 12 would be designed to support a bucket (not shown) utilized for excavating.

The present invention comprises a compactor attachment designated generally by the numeral 16. Compactor attachment 16 comprises a box housing 18 that is mounted on framework 12 in a manner readily apparent to those skilled in the art. Bolts 20 permit the top cover of housing 18 to be removed from the remainder of the housing so as to provide easy access to the interior. Housing 18 includes a platform 22 which supports the reciprocating drive assembly. The housing also mounts compactors 26 as will be more fully explained hereinafter.

Figure 5:
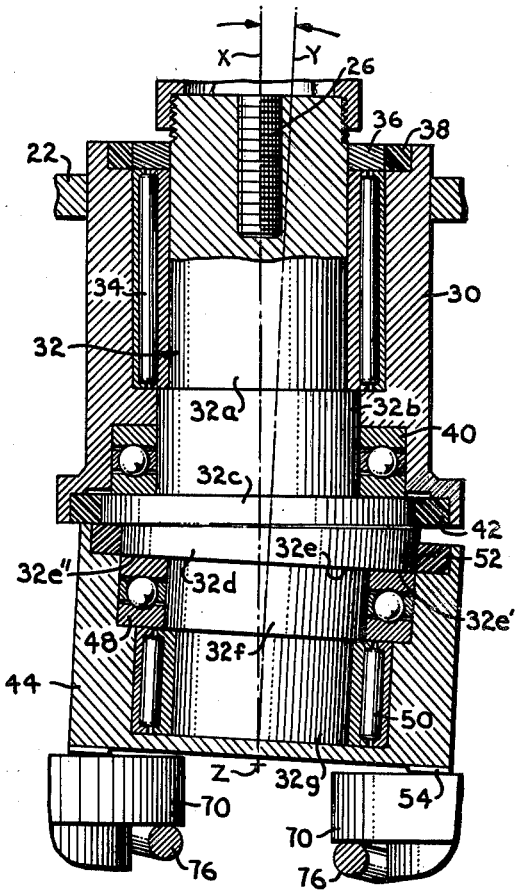
FIG. 5 is a further enlarged fragmentary elevational view of the drive mechanism with portions broken away and shown in cross-section to reveal details of constructions.

Referring now to FIG. 5, motor 24 is disposed in a generally upright position so that the axis of its output shaft 26 is generally vertical. A first bell housing 30 mounts a rotatable member 32 which receives shaft 26 in driving engagement. A first cylindrical section of member 32 is designated by the numeral 32*a* and is surrounded by needle bearing assembly 34. A keeper 36 and seal 38 close the upper end of the assembly. A second integral section of member 32 is designated 32*b* and is of slightly larger diameter than first section 32*a*. Section 32*b* is integral with a third section 32*c* of still greater diameter which presents a lip between sections 32*b* and 32*c*. Section 32*c* is in turn integral with a fourth section 32*d* that presents an oblique planar face 32*e*. That is, surface 32*e* is oblique relative to the axis of rotation of the member 32. The lip presented by section 32*c* mounts a roller thrust bearing assembly 40. The lower end of housing 30 is closed by annular seal 42.

An inverted bell housing 44 mounts the lower portion of the drive assembly which includes a fifth integral section 32*f* of member 32, which section extends perpendicularly away from surface 32*e*. A sixth integral section 32*g* of slightly smaller diameter than section 32*f* extends beneath the latter. A second ball thrust bearing assembly 48 surrounds section 32*f* and a second needle bearing assembly 50 surrounds section 32*g*. An annular seal 52 seals the upper open end of housing 44. A wear plate 54 is disposed on the outside of housing 44 at its lowermost end. It is to be noted that the axis of rotation of sections 32*a*, 32*b*, and 32*c*, which axis is designated "x" in the drawing, intersects the axis of rotation of sections 32*d*, 32*f* and 32*g*, which axis is designated "y" in the drawing, at a point "z" beneath the lower end of housing 44. Sections 32*f* and 32*g* present an effective cylindrical drive member that moves housing 44.

Figure 3:
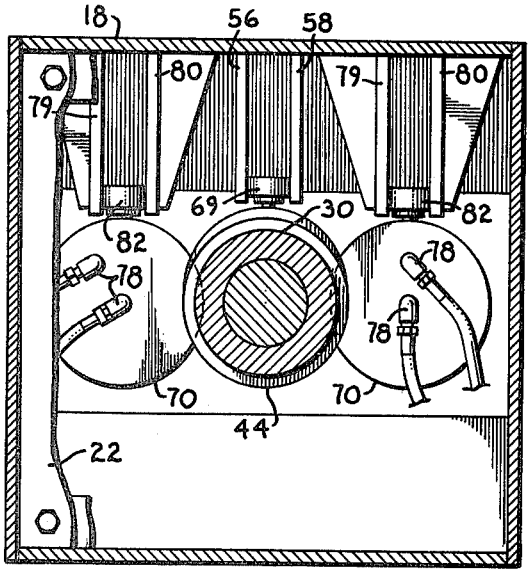
FIG. 3 is a horizontal, cross-sectional view taken along line 3-3 of FIG. 2.

As indicated in FIG. 3, plates 56 and 58 which are welded to housing 18 present a guideway for a cam follower 60 that is rigidly coupled with housing 44. This precludes the housing from rotating under the influence of member 32.

Figure 2:
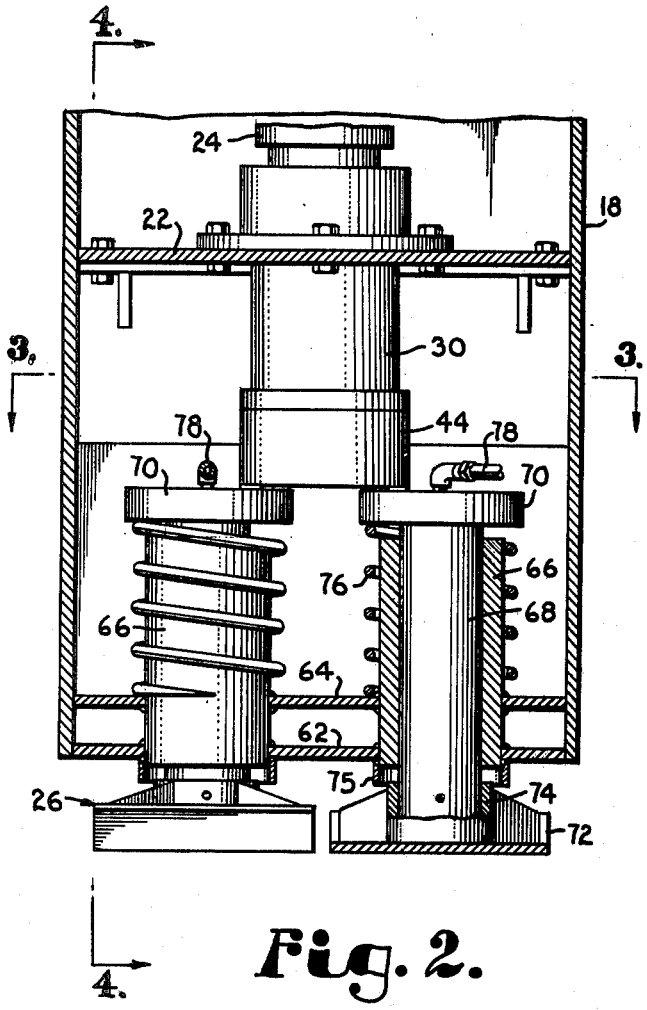
FIG. 2 is an enlarged elevational view of the compactor shown in FIG. 1 with portions broken away and shown in cross-section to reveal details of constructions.
Figure 4:
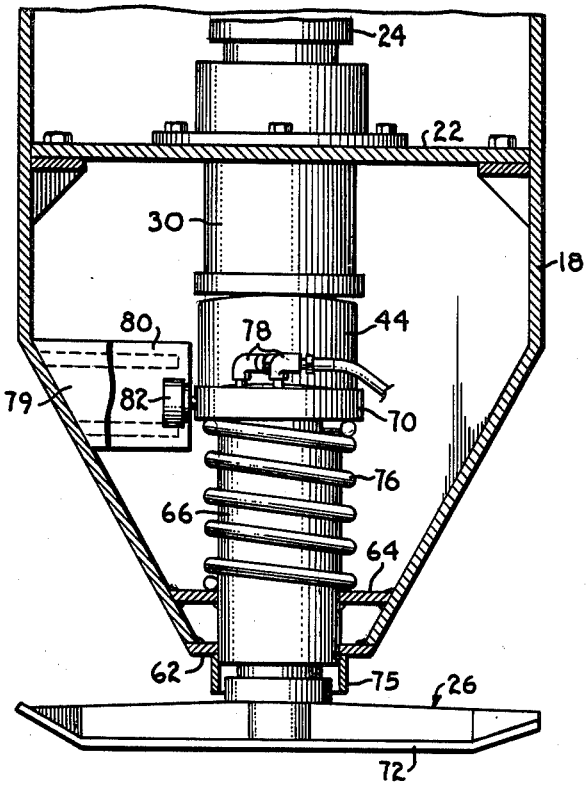
FIG. 4 is a vertical, cross-sectional view taken along line 4-4 of FIG. 3.

Referring to FIGS. 2, 3 and 4, details of the reciprocating compactors 26 will now be described. As each of the compactors 26 is identical, only one will be described in detail and like reference numerals will be used on both. Horizontal plates 62 and 64 at the bottom of housing 18 mount upright cylindrical sleeves 66. A round shaft 68 is received by sleeve 66 and has an upper terminal cap 70 of a diameter slightly larger than that of the sleeve. A tamping foot 72 is removably mounted at the opposite end of shaft 68 through a collar 74. A sleeve extension 75 integral with sleeve 66 projects below the latter and extends partially around collar 74. This provides an effective barrier against dirt entering sleeve 66. A coil spring 76 surrounds sleeve 66 and has one end resting on plate 64 while the opposite end biases against cap 70. Each cap 70 is provided with grease fittings 78.

Two sets of guide plates 79 and 80 are rigidly mounted to housing 18 to provide a guideway for a cam follower 82 that is rigid with cap 70. Cam follower 82 assures that shaft 68 will move in a rectilinear path and not rotate. Grease fittings 78 provide means for greasing sleeve 66 as well as cam follower 82.

Figure 6:
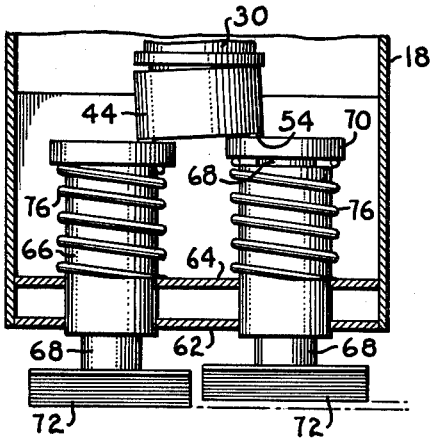
FIG. 6 is a fragmentary elevational view of the compactor utilizing the drive mechanism of the invention depicting one tamping foot being forced down by the drive member while the other foot is in its raised position.
Figure 7:
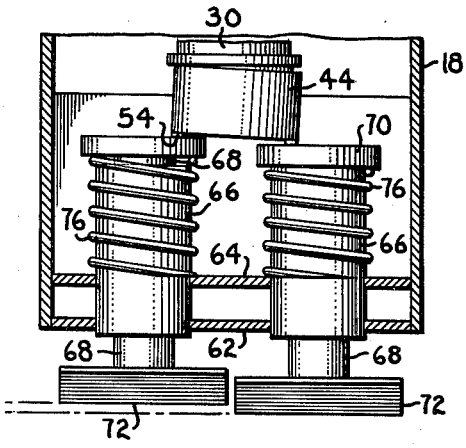
FIG. 7 is a view similar to FIG. 6 showing the reciprocal position of the two compacting feet.

In operation, motor 24 is activated through hydraulic fluid supplied by the hydraulic system of the tractor (not shown) which mounts boom 10. The motor rotates member 32 which results in rotation of oblique surface 32*e*. Surface 32*e* will at all times have a first portion 32*e'* at one elevation and a second portion 32*e''* at another elevation. As portion 32*e'* moves from the righthand side of the housing, as illustrated in FIG. 5, to the lefthand side of the housing, this portion also moves in the direction of the left reciprocating shaft 68 forcing the shaft downwardly as illustrated in FIG. 6. Simultaneously, surface portion 32*e''* has moved to the righthand side of the housing, when viewing FIG. 5, thus rising to a higher elevation than portion 32*e'* and allowing the righthand reciprocating shaft 68 to be biased upwardly by spring 76 as illustrated in FIG. 6. As member 32 continues to rotate, the relative positions of surface portions 32*e'* and 32*e''* will again be reversed causing the righthand side of housing 44 to push downwardly on the righthand reciprocating shaft 68 thereby forcing compactor foot 72 downwardly, as illustrated in FIG. 7.

In the foregoing manner, the rotating action of member 32 is translated, through the drive member comprising sections 32*f* and 32*g*, into a "wobbling action" of housing 44 which reciprocates compactors 26 along rectilinear paths to effect a compacting action. It should be appreciated that the total effective stroke of each of shafts 68 is only a fraction of an inch. While the reciprocating drive mechanism has been described with particular reference to a compacting device and finds advantageous application with a compactor designed for attachment to a back hoe boom, it is to be understood that the drive may be employed to effect other reciprocating movements.

From the foregoing description, it will be appreciated that the present invention provides for an improved reciprocating drive means which meets all of the objectives heretofore set forth.

Having thus described the invention, I claim:

1. A compacting device comprising:

a box housing;

a motor mounted on said box housing and having its output shaft disposed along a generally vertical axis;

a rotatable member coupled with said shaft for rotation about said axis, said member having a generally planar surface disposed in a plane oblique to said axis;

a generally cylindrical drive member integral with said rotatable member and extending perpendicular to said planar surface;

a bell housing partially enclosing said cylindrical drive member and adapted to be acted upon by said drive member, said bell housing presenting a generally planar drive surface;

bearing means disposed between said bell housing and said drive member to accomodate rotation of the latter within said bell housing;

means for holding said bell housing against rotation;

first and second driven shafts mounted in said box housing, each of said driven shafts having a planar contact surface in engagement with said drive surface;

first and second tamping feet coupled with said first and second driver shafts, respectively;

first and second spring means coupled with said box housing and disposed to act on said first and second driven shafts, whereby said drive member alternately moves said driven shafts in a downwardly direction and said spring means move said driven shafts in the opposite direction.

2. A compacting device as set forth in claim 1, wherein is included a sleeve rigid with said box housing for each of said driven shafts; and means for holding each of said driven shafts against rotation.

3. A compacting device as set forth in claim 2, said device being adapted to be coupled with a back hoe, and said motor comprising a hydraulic motor.

* * * * *